US006006664A

United States Patent [19]

Hummel et al.

[11] Patent Number: 6,006,664

[45] **Date of Patent: *Dec. 28, 1999**

[54] OFFSET PRINTING DEVICE FOR A ROTARY PRINTING MACHINE

[75] Inventors: Peter Hummel, Offenbach; Robert Ortner, Alzenau, both of Germany

[73] Assignee: MAN Roland Druckmaschinen AG, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/880,046

[22] Filed: Jun. 20, 1997

[30] Foreign Application Priority Data

Jun. 22, 1996 [DE] Germany ..... 196 25 030

[51] Int. Cl.[6] ..... B41F 31/10; B41L 27/12

[52] U.S. Cl. ..... 101/350.4

[58] Field of Search ..... 101/350.1, 249.1, 101/350.2, 350.3, 350.4, 352.08, 148, 207–210, 363, 364

[56] References Cited

U.S. PATENT DOCUMENTS

| | | | |
|---|---|---|---|
| 3,467,008 | 9/1969 | Domotor | 101/142 |
| 5,272,971 | 12/1993 | Fredericks | 101/136 |
| 5,345,865 | 9/1994 | Kemp | 101/348 |
| 5,562,031 | 10/1996 | Garner et al. | 101/148 |

FOREIGN PATENT DOCUMENTS

| | | |
|---|---|---|
| 1808909 | 3/1974 | Germany . |
| 2658362 | 11/1980 | Germany . |
| 4423286 | 1/1996 | Germany . |

*Primary Examiner*—J. Reed Fisher
*Attorney, Agent, or Firm*—Leydig, Voit & Mayer, Ltd.

[57] ABSTRACT

An offset printing device is provided for a rotary printing machine having a plate cylinder carrying a dry flatbed printing plate, the printing device having an improved inking unit which reduces the occurrence and effect of contaminants. In the inking unit, at least one ink application roller, which is frictionally engaged against the plate cylinder during printing, is drivable by at least one positively driven inking roller at a peripheral speed which is different from the peripheral speed of the plate cylinder. In an embodiment, a plurality of ink application rollers contact the plate cylinder and are respectively driven at successively differing peripheral speeds.

7 Claims, 3 Drawing Sheets

OFFSET PRINTING DEVICE FOR A ROTARY PRINTING MACHINE

FIELD OF THE INVENTION

The invention relates to an offset printing device for a rotary printing machine and more particularly relates to an inking roller arrangement.

BACKGROUND OF THE INVENTION

A conventional offset printing device is disclosed in German patent publication DE 44 23 286 Al, in which a plate cylinder carries a printing form suitable for offset printing without damping solution by a process known as dry offset printing. The printing form is inked with an appropriate printing ink. In order to eliminate or to prevent contaminants, which are undesirably reproduced in the printed image on the material being printed, an additional application roller can be thrown onto and off of the printing form, independently of the ink rollers present. The additional application roller can be switched into two operating positions. In the first operating position, the application roller is thrown onto the printing form, and the application roller can be operated at a peripheral speed which differs from the peripheral speed of the plate cylinder. In the in the second operating position, the application roller is thrown off from the printing form, but is integrated into the inking unit.

A wet offset printing device is disclosed in German patent publication DE-B 18 08 909. In order to remove contaminants from the printing form, at least one application roller of the damping or inking unit can be driven at a different peripheral speed than the peripheral speed of the plate cylinder by a gear train in a positively locking manner. This mode of operation is not suitable for a dry offset plate, which has a non-metallic surface coating, since the dry offset printing plate is less wear-resistant than a printing plate for offset printing which transfers damping medium. Furthermore, the contaminants in the inking unit or the damping unit are transported further to a roller, where the accumulated contaminants must be removed at specific intervals.

OBJECTS AND SUMMARY OF THE INVENTION

An object of the invention is to develop an offset printing device which appreciably reduces contaminants occurring during offset printing, particularly in dry flatbed printing.

By means of the invention, contaminants are appreciably reduced by driving at least a first ink application roller at a different peripheral speed than the plate cylinder. To this end, an improved printing unit is provided in which at least one ink application roller of the inking unit is frictionally driven by at least one adjacent inking roller, preferably an ink distributor roller, at a peripheral speed which is different from the peripheral speed of the plate cylinder. Multiple ink application rollers may be provided, and in such an embodiment, at least the first ink application roller as viewed with respect to the direction of rotation of the plate cylinder, is preferably driven with the greatest speed differential. The speed differential is preferably such that ink application roller rotates at a lower peripheral speed than the plate cylinder peripheral speed, however, the ink application roller may alternatively rotate at a higher peripheral differential speed in accordance with the invention as well.

In alternative embodiments of the invention wherein the printing unit has a plurality of ink application rollers, some or all of the ink application rollers may be driven at respective peripheral speed differentials relative to the peripheral speed of the plate cylinder, each being positively driven by respective inking rollers. The ink application rollers driven in accordance with the invention each have a rotational direction opposite to that of the plate cylinder and the aforementioned speed differential causes a peripheral slip and wiping effect at the contact point to the plate cylinder. Because of this relative slippage, the ink application roller picks up contaminants from the dry offset printing plate and transfers the contaminants to the adjacent inking roller driving it. The contaminants are destroyed or appreciably reduced in size at the contact point between the application roller and the inking roller or between the application roller and the plate cylinder or at a roller contact point elsewhere in the printing unit to which the contaminants are carried, so that negative effects on the printing quality are reduced or eliminated. Advantageously, a printing unit according to the invention eliminates a need for a so-called dirt catcher roller.

In keeping with the invention, not only one, but rather several or all of the ink application rollers are operated at a peripheral speed differing from the plate cylinder peripheral speed, in a first operating position. This provides an advantage in that there are a plurality of wiping contact points between ink application rollers and dry offset printing plate, achieving a cleaning effect to maintain the dry flatbed printing plate. In this embodiment, it is possible that the differential magnitudes of the peripheral speeds are lower than in the prior art, such as in DE-B 18 08 908, discussed above. Depending on the subject to be processed and/or on the material to be printed, the inking rollers can be switched over to a second operating position wherein the inking rollers are positively driven at a synchronous speed in relation to the peripheral speed of the plate cylinder. For uses in which few or no contaminants occur, the wear behavior of the dry flatbed printing plate is improved.

BRIEF DESCRIPTION OF THE DRAWING

These and other features and advantages of the invention will be more readily apparent upon reading the following description of a preferred exemplified embodiment of the invention and upon reference to the accompanying drawings, wherein.

While the invention will be described in connection with certain preferred embodiments, there is no intent to limit it to those embodiments. On the contrary, the intent is to cover all alternatives, modifications and equivalents included within the spirit and scope of the invention as defined by the appended claims.

DETAILED DESCRIPTION OF THE DRAWINGS

Figure 1:
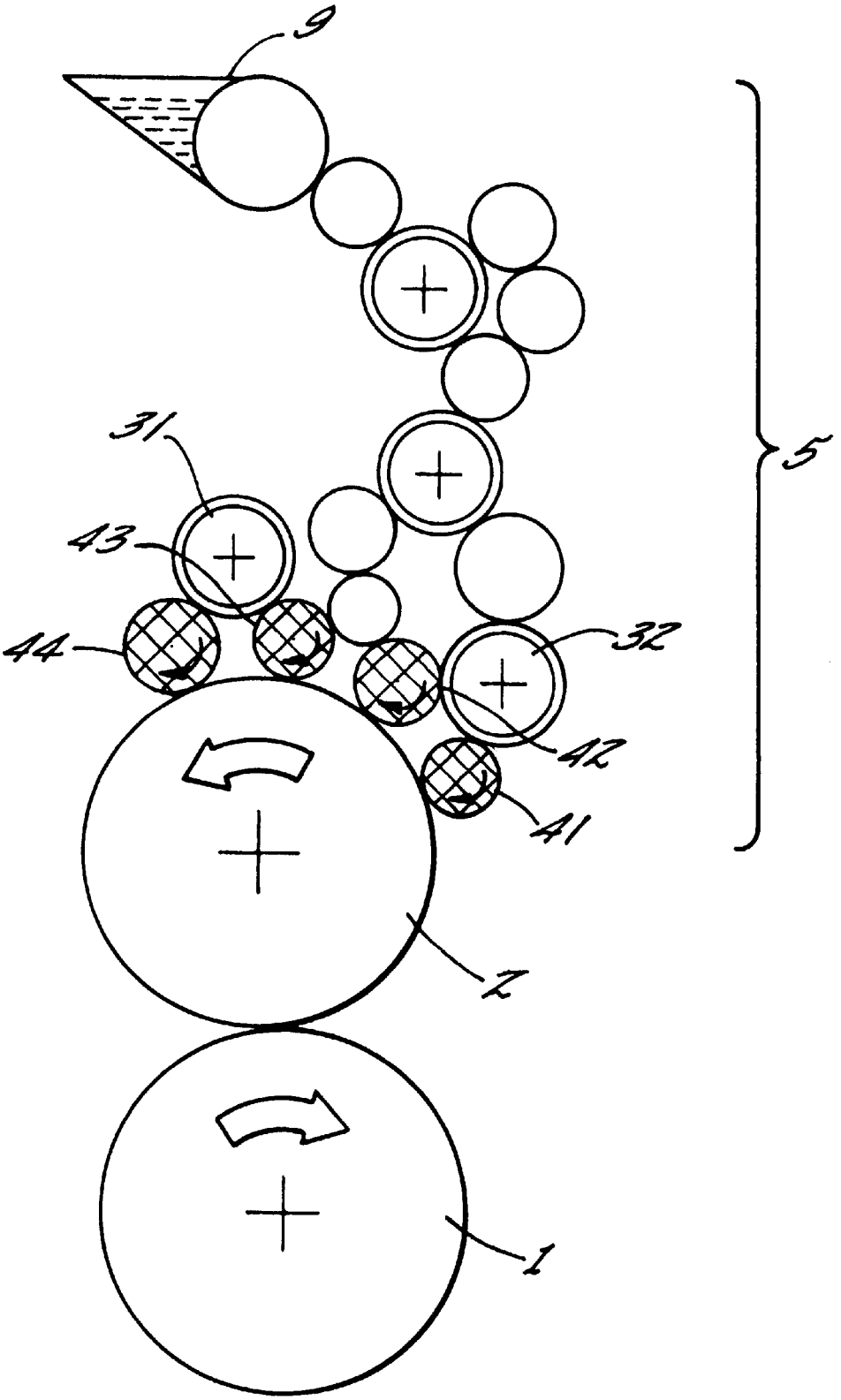
FIG. 1 is a schematic side view of a printing unit according to an embodiment of the invention.

Now referring to the drawings, in FIG. 1 there is shown a printing unit according to the invention including a rubber blanket cylinder 1 and a plate cylinder 2. The plate cylinder 2 carries a dry offset printing plate for waterless offset printing. The printing unit includes an inking unit 5 which has a plurality of rollers adapted to apply ink to the dry offset printing plate with a printing ink which is suitable for waterless offset printing. In particular, the inking unit includes a plurality of ink application rollers 41, 42, 43 and 44 which are mounted to be selectively thrown on and off of the plate cylinder 2.

The inking unit 5 includes inking rollers 31 and 32, which are positively driven in a rotational manner. The inking unit 5 provides inking communication from a conventional ink fountain 9 having a ductor roller to the dry flatbed plate cylinder 2. In the present example, the inking rollers 31 and 32 are preferably designed as ink distributor rollers. The ink application rollers 41, 42 and 43, 44 positioned in drivable contact with the inking rollers 31, 32, respectively.

According to the invention, contaminants are appreciably reduced by driving at least a first ink application roller, as viewed in a rolling direction against a plate cylinder, at a different peripheral speed than the plate cylinder. The ink application rollers are frictionally driven by one or more adjacent inking rollers. An exemplary mode of operation is as follows. During printing operation, the ink application rollers 41, 42, and 43, 44 are continuously driven by the respectively adjacent inking rollers 31, 32 with a peripheral speed which differs from the peripheral speed of the plate cylinder, the peripheral speed differential, ranging within 2% to 10% relative to the peripheral speed of the plate cylinder 2. A greater differential is undesirable in most cases, because the service life of current dry flatbed printing plates might be diminished. According to this example, the ink application rollers 41, 42, 43 and 44 are driven with identical speed differentials, e.g., 5%, with respect to the peripheral speed of the plate cylinder 2.

Alternatively, the multiple ink application rollers 41, 42, 43, and 44 are frictionally driven at respectively different differential speeds relative to the peripheral speed of the plate cylinder 2. In such an embodiment, the first ink application roller 41 (as viewed relative to the rotation direction of the plate cylinder 2) is preferably driven with the greatest speed differential relative to the peripheral speed of the plate cylinder 2, e.g., 8%. Following the first ink application roller 41, each subsequent ink application roller 42, 43, and 44 is preferably driven at a successively decreased speed differential. For example, the second ink application roller 42 is driven at a 6% difference in peripheral speed relative to the plate cylinder, the third ink application roller 43 at a 4% difference in peripheral speed relative to the plate cylinder, and the fourth ink application roller 44 at a 2% difference in peripheral speed relative to the plate cylinder.

Also keeping with the invention, depending on the roller geometry of the inking unit 5, the first and second ink application rollers 41 and 42, are driven synchronously by the adjacent inking roller 31 at a differential magnitude of 4% in relation to the peripheral speed of the plate cylinder 2. The subsequent third and fourth ink application rollers 43 and 44 are likewise driven in synchronously by the respectively adjacent inking roller 32 at a differential magnitude of the peripheral speed of 2% in relation to the peripheral speed of the plate cylinder 2.

Various other patterns of speed differentials among the ink application rollers 41, 42, 43 and 44 relative to the dry offset plate cylinder 2 are possible according to the invention. For example, the first ink application roller 41 may be driven by its respective inking roller 31 at a peripheral speed which differs from the peripheral speed of the plate cylinder, while each of the subsequent ink application rollers 42, 43, 44 is driven by the other inking rollers 32 at the same peripheral speed as the plate cylinder 2. For this mode of operation, the inking roller 31 which is drives the first ink application roller 41 does not contact the second ink application roller 42.

Figure 2:
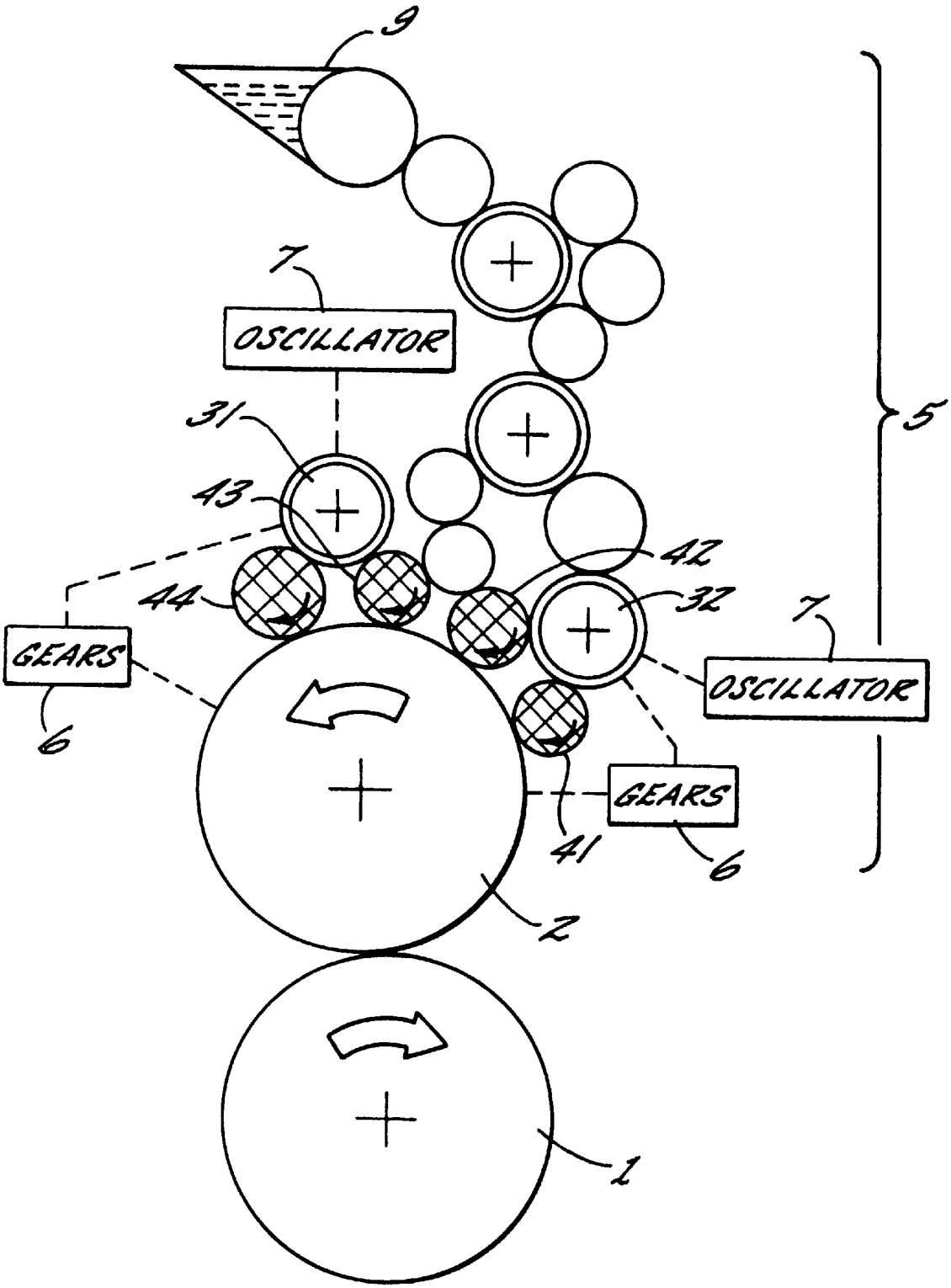
FIG. 2 is a schematic side view of a printing unit according to an embodiment of the invention wherein the inking rollers are geared to the plate cylinder and are oscillated.

It will be understood that, as illustrated in FIG. 2, the inking rollers 31 and 32 are coupled in a positively locking manner to the plate cylinder 2 by gears 6. In addition to being driven rotationally, the inking rollers 31 and 32 are preferably also driven in an oscillating manner by an oscillator 7 of a known type. In this case, the ink application rollers 41, 42, 43 and 44 are oscillatingly contacted by the inking rollers 31, 32.

Figure 3:
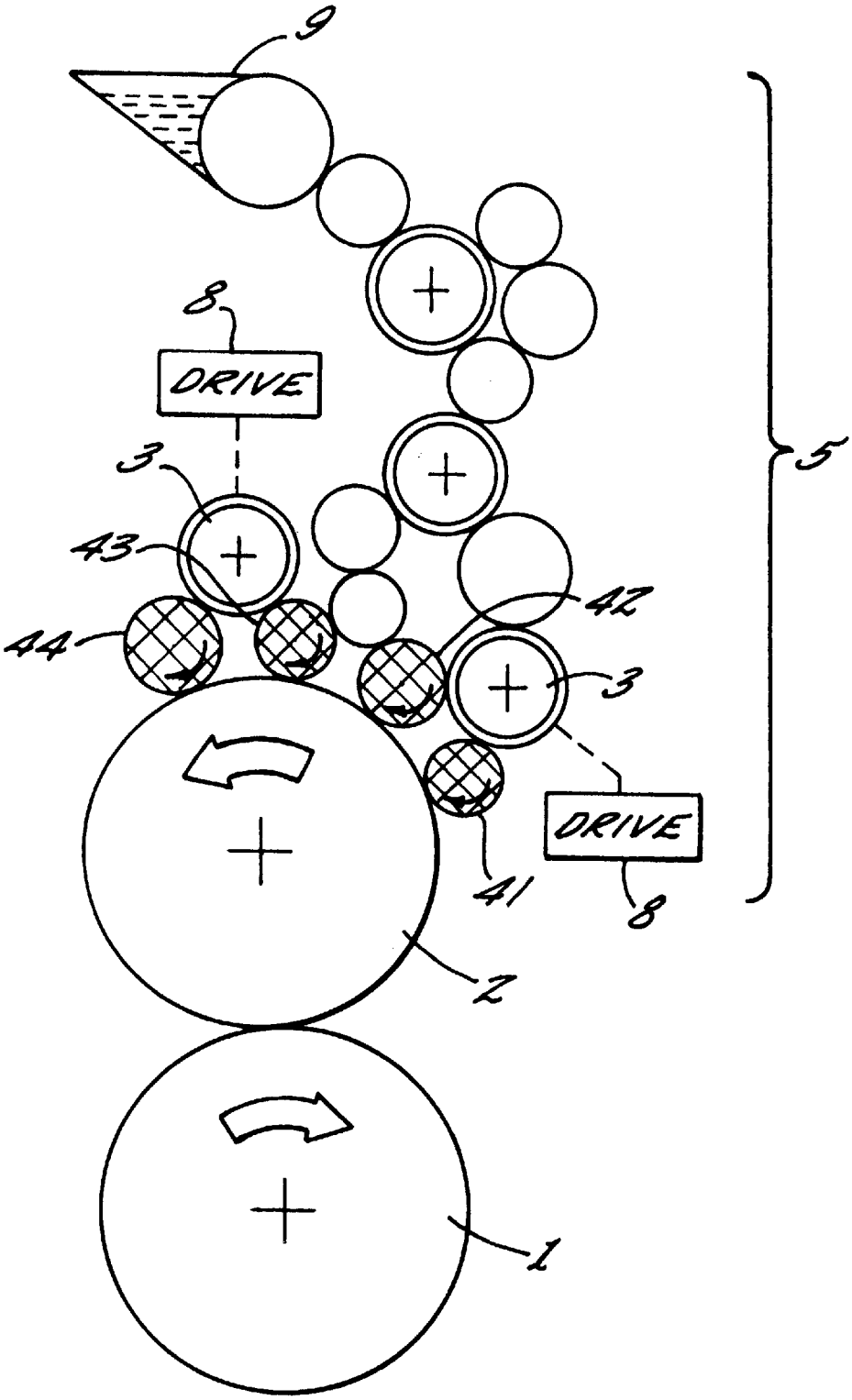
FIG. 3 is a schematic side view of a printing unit according to an embodiment of the invention wherein the inking rollers are individually driven.

Alternatively, as illustrated in FIG. 3, a known type of individual drive 8 is provided to independently drive each inking roller 31, 32. Alternatively, an appropriate drive may be provided to commonly drive the inking rollers in a known manner, but decoupled from the plate cylinder 2.

What is claimed is:

1. An offset printing device for a rotary printing machine comprising a rotatable plate cylinder carrying a dry offset printing plate having a non-metallic surface coating for waterless offset printing and an inking unit for applying printing ink suitable for waterless offset printing to the printing plate, said inking unit including at least a first ink application roller in frictional contact with said plate cylinder during a printing operation and at least a first inking roller in frictional contact with said ink application roller, said plate cylinder and first inking roller each being positively gear driven, said first ink application roller being frictionally driven by frictional contact with said plate cylinder and first inking roller without a positive gear drive, and said first inking roller being positively driven at a peripheral speed different from the peripheral speed of said plate cylinder for causing a peripheral slip and wiping effect at the contact point between the plate cylinder and ink application roller for dislodging contaminants from the surface of the printing plate without damaging the non-metallic surface coating thereof.

2. The offset printing device according to claim 1, further comprising a second ink applicator roller, the first and second ink application rollers each being frictionally driven by said inking roller and plate cylinder without a positive gear drive at peripheral speeds which are different from said peripheral speed of said plate cylinder.

3. The offset printing device according to claim 2, further comprising third and fourth ink application rollers, the third and fourth ink application rollers each being frictionally driven by a second said inking roller and said plate cylinder without a positive gear drive at peripheral speeds which are different from said peripheral speed of said plate cylinder.

4. The offset printing device according to claim 1, comprising a second inking roller frictionally driven by a positively driven inking roller and said plate cylinder at a peripheral speed different from a peripheral speed of the plate cylinder but less than the peripheral speed of the first ink application roller.

5. The offset printing device according to claim 1, wherein said at least one inking roller is drivable in an oscillating manner.

6. The offset printing device according to claim 1, wherein said at least one positively driven inking roller is gear driven by the plate cylinder.

7. The offset printing device according to claim 1 including a second ink application roller in contact with the plate cylinder, and a second positively driven inking roller in frictional contact said second ink application roller, and said inking rollers each being respectively coupled to an individual positive drive.

* * * * *